United States Patent [19]

Verschuur

[11] 4,302,211

[45] Nov. 24, 1981

[54] PROCESS FOR IMPROVING FLOW CHARACTERISTICS OF COAL PRODUCED BY DEWATERING AQUEOUS COAL SLURRIES

[75] Inventor: Eke Verschuur, Amsterdam, Netherlands

[73] Assignee: Shell Oil Company, Houston, Tex.

[21] Appl. No.: 195,980

[22] Filed: Oct. 10, 1980

[30] Foreign Application Priority Data

Jan. 23, 1980 [GB] United Kingdom ..... 2294/80

[51] Int. Cl.[3] ..... C10L 5/14; F26B 5/14

[52] U.S. Cl. ..... 44/24; 44/15 R; 34/9; 34/14

[58] Field of Search ..... 44/15 R, 23, 24; 241/20; 34/9, 12, 14

[56] References Cited

U.S. PATENT DOCUMENTS

| | | | |
|---|---|---|---|
| 3,377,146 | 4/1968 | Von Stroh | 44/15 R |
| 4,021,206 | 5/1977 | Huberts et al. | 44/24 X |
| 4,126,426 | 11/1978 | Verschuur | 44/24 |
| 4,234,320 | 11/1980 | Verschuur | 44/24 X |
| 4,248,697 | 2/1981 | Halvorsen | 44/24 X |

*Primary Examiner*—Carl F. Dees

[57] ABSTRACT

A relatively dry coal product can be prepared from aqueous slurries of respectively fine and granular coal particles by agitating the fine particles with water and binder to form mechanically separable agglomerates and, before separating them from most or all of the liquid in which they were formed, mixing those agglomerates with the relatively large coal particles in a specified proportion, and then mechanically dewatering the mixture.

1 Claim, 2 Drawing Figures

PROCESS FOR IMPROVING FLOW CHARACTERISTICS OF COAL PRODUCED BY DEWATERING AQUEOUS COAL SLURRIES

BACKGROUND OF THE INVENTION

This invention relates to a process for preparing a coal product from aqueous slurries of relatively fine and relatively granular coal particles. More particularly, the present invention relates to an improved procedure for conducting a process of the type described in U.S. Pat. No. 4,126,426.

Coal slurries may result from coal mining, coal transport or various processing carried out in order to upgrade the coal. In general, although quite large lumps (larger than say 25 mm) may be present, the majority of the particles are below 25 mm. Most slurries in fact comprise a substantial proportion of relatively fine particles which are smaller than about 100 microns, the remainder being relatively granular particles which are sized between about 100 microns and 25 mm. The choice of the limit of 100 microns here is made for convenience. In practice, the somewhat arbitrary dividing line between what are called fines and what are called grains is chosen somewhere in the range 75 to 250 microns. Those skilled in the art will bear this in mind in interpreting the present invention.

While the relatively granular particles in an aqueous slurry can be dewatered (that is to say separated from significantly more than the bulk of the water in which they are in suspension) by mechanical means, for example, screen filters or centrifuges, the relatively fine particles in an aqueous slurry cannot.

The term "agglomeration" as used herein refers to a process in which particles in an aqueous suspension are subjected to turbulence in the presence of a binder which is capable of wetting the surface of the particles and thus can cause the particles to stick together in clusters or so-called agglomerates. Selective agglomeration occurs when the binder preferentially wets certain solids. Those which are preferentially wetted, such as coal particles in the case of a hydrocarbon binder, are then agglomerated while those which are not, such as ash, remain in supension, U.S. Pat. No. 4,021,206 and corresponding United Kingdom application Nos. 5482/75 and 45156/75, filed Feb. 10 and Oct. 31, 1975, describe separating an aqueous slurry of mixed size coal particles by removing the larger particles (along with the water wetting their surfaces), agglomerating the remaining finer particles by agitating them with water and binder to form agglomerates which can be mechanically separated from the bulk of the liquid in which they were formed, then drying each of the products.

U.S. Pat. No. 4,126,426 and corresponding United Kingdom application No. 24836/77 filed June 14, 1977, describes a method of improving the products provided by U.S. Pat. No. 4,021,206 by using only about 8 to 10% by weight of the binder to form the agglomerates, mechanically dewatering the agglomerates, then mixing the agglomerates with the previously removed larger particles of coal.

Netherlands patent application No. 7807223 filed July 4, 1978, describes agglomerating an aqueous slurry of mixed size coal particles by agitating the mixed particles with water and a binder to yield mechanically-dewaterable agglomerates, dewatering those agglomerates and re-treating them with hot water and relatively viscous binder (to form hot agglomerates which are relatively hard) while recycling the unagglomerated coal particles back to the first agglomerating zone.

The above patents and applications and the references cited regarding the U.S. patents are believed to comprise the most pertinent references known to the applicant. The disclosures of the U.S. Pat. Nos. 4,021,206 and 4,126,426 are incorporated herein by cross reference.

SUMMARY OF THE INVENTION

The present invention relates to preparing a coal product from aqueous slurries containing, respectively, relatively fine coal particles and relatively granular coal particles. The relatively fine particles are agitated in contact with water and a binder so that the coal particles form agglomerates capable of being mechanically separated from the liquid in which they were formed. But, before those agglomerates are mechanically separated from a significant proportion of said liquid, the wet agglomerates are mixed with the relatively granular particles of coal in a proportion such that the agglomerates constitute from about 20 to 65% by weight of the solids in that mixture. The mixture is then mechanically dewatered to separate it from significantly more than the bulk of the liquid it contains.

In preferred embodiments the relatively granular coal particles are mechanically dewatered (by removing at least the bulk of the water in which they were slurried) before they are mixed with said agglomerates and/or, after the relatively granular coal particles are mixed with the agglomerates, the mixture is mechanically dewatered in a manner causing the disintegration of at least a significant proportion of the agglomerates.

The slurries used can be individually obtained and/or fractions obtained by separating a slurry of mixed size particles. By combining the wet agglomerated fines with the larger particles before dewatering the agglomerates, the coal particles become more uniformly dispersed one in another and, on being stored subsequently, have improved flow characteristics. A further advantage of the present process is that only a single mechanical dewatering means is required.

In addition it has been found that the handleability of the resulting dewatered solids is still further improved if the agglomerates are caused to disintegrate during the mechanical dewatering step. Somewhat surprisingly, the resulting substantially homogeneous mixture of the grains and crushed agglomerates has exceedingly good flow characteristics, and permits a very much smaller hopper exit, for example, than would otherwise be the case. Such a homogeneous mixture also has good non-dusting properties.

In a variant of the present process a relatively large amount of binder is used to agglomerate the relatively smaller particles, namely between 10 to 30% by weight based on the solids, in order to form relatively strong agglomerates from which a portion of water can be drained before the agglomerates are mixed with the relatively granular coal particles. The mixture is then dewatered mechanically, preferably until the agglomerates disintegrate. Where such a relatively large amount of binder is employed, a very low rank binder can be used, but will nevertheless enhance the mean final calorific value of the coal. In addition, because the water can so easily be drained from the relatively strong agglomerates, the main effect of the invention can still be obtained with a relatively small centrifuge for mechanically dewatering the mixture of particles and agglomerates.

The actual choice of a particular binder does not form part of the invention. However, it is important that the binder be suitable for agglomerating coal particles. Hydrocarbon binders have the advantage that they wet the coal particles well and do so in preference to other non-combustible solids which may also be present, such as ash. They may also beneficially increase the net calorific value of the product coal to such an extent as to justify their use in relatively large proportions compared to the coal.

Although gas oil and equivalent lighter hydrocarbons tend to be more selective for the coal in the agglomeration step, they have the disadvantage of giving off potentially dangerous vapors and a noxious odor. This type of binder is also costly. Preferred binders are heavy (or long) residue from various cracking processes. Their price is generally no more than three times that of the coal, and their calorific value may well be twice that of the coal. Coal tar is also suitable.

The binder may be added as a liquid, either neat or in the form of an aqueous emulsion or, in the case of heavier residues, in powdered form. Depending upon the nature of the binder, the agglomeration can be carried out at ambient temperature or at elevated temperature, for example between 60° and 80° C.

DESCRIPTION OF THE INVENTION

In the embodiment shown in both figures, a first slurry comprising relatively smaller particles, "fines", enters an agglomeration vessel 10 by line 12. Binder is added via line 14 in a dosed quantity. In both figures, the mixture of the slurry and the binder is subjected to turbulence in the vessel 10 for a prescribed time and then leaves by line 16.

Figure 1:
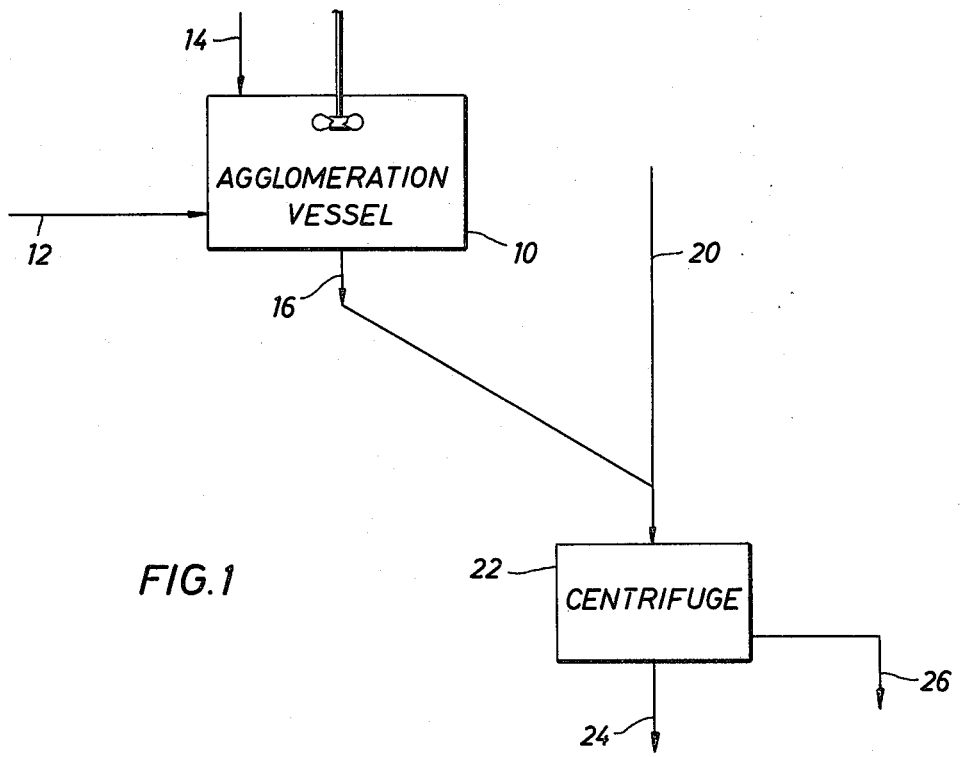
FIG. 1 is a schematic block diagram of a plant for carrying out a process in accordance with the invention; and, FIG. 2 is a schematic block diagram of a plant for carrying out an alternative process in accordance with the invention.

In FIG. 1, the agglomerates along with the water and non-agglomerated matter are mixed with a second slurry of relatively larger particles via line 20, and the mixture is passed to a centrifuge 22 where the coal is separated from the water and non-agglomerated matter.

Figure 2:
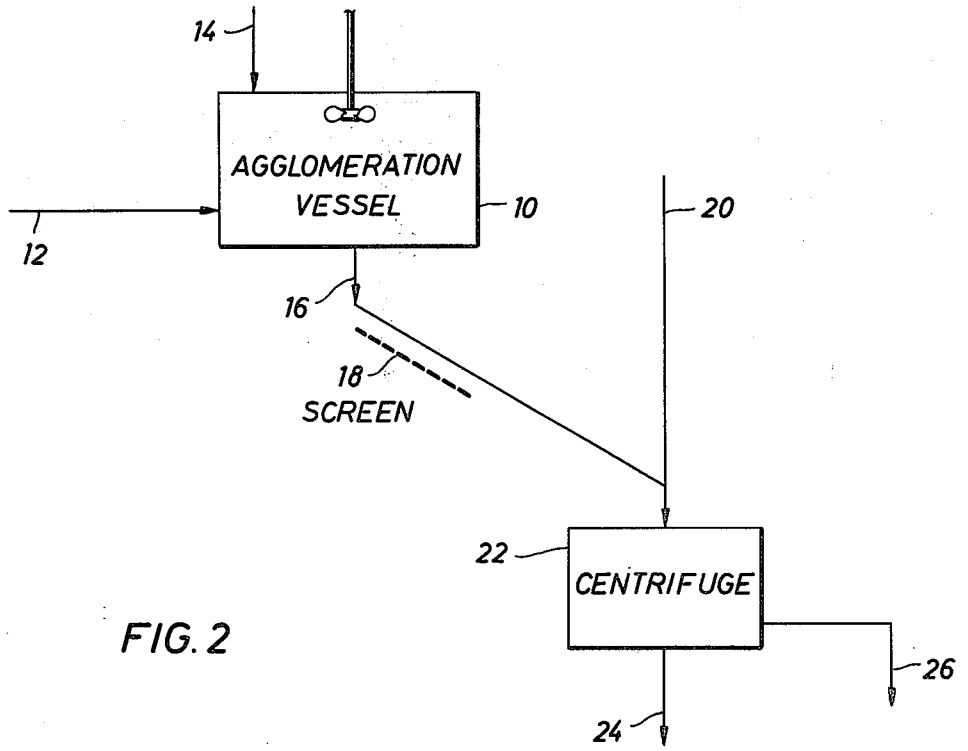

In FIG. 2, the resulting agglomerates are separated from some of the water and non-agglomerated matter over a screen 18.

The dewatered coal product leaves the centrifuge 22 by line 24 and the water and non-agglomerated matter by line 26. Where desired, additional mechanical and/or thermal dewatering and/or drying can be added.

EXAMPLES

1. A pipeline slurry ($d_{50}=100$ micron; $d_{98}=800$ micron, wherein the figures 50 and 98 indicate the percentage smaller than 100 and 800 microns respectively) of West Virginia coal containing 6.5% ash was classified at nominally 100 microns which resulted in approximately 50% by weight fines (<100 microns) and 50% by weight grains (>100 microns).

A first slurry comprising the fines and having a solids content of 20% by weight was agglomerated at 80° C. using 18.4% by weight (based on the solids) heavy residue. The resulting agglomerates, of 3 to 5 mm diameter, were separated from the water and non-agglomerated material over a screen. The agglomerates contained 16.9% by weight water and 4.7% by weight ash (amounting to a reduction of from about 80 to 17% by weight of the liquid in which they were formed).

A second slurry comprising the grains and having a solids content of approximately 20% were dewatered in a screen bowl centrifuge. The resulting grains contained 8% by weight water and 6.5% by weight ash.

Equal proportions by weight of the agglomerates and the grains were blended together to a product containing 12.5% by weight water and 5.7% by weight ash.

Upon handling the agglomerates showed a tendency to segregate from the grains. This phenomenon made proper analysis of the blended product impossible and tended to block the bunker used. The minimum size bunker opening for unrestrained flow would be in excess of 2.5 mm.

2. As before, the first slurry was agglomerated, but instead of dewatering it directly, it was mixed back with an equal quantity of the second slurry. The resulting blend was dewatered in the screen bowl centrifuge and was analyzed.

It was found that the blend contained 4.8% by weight water and 4.8% by weight ash, and that the agglomerates had been broken into smaller fragments. These fragments were, and remained, uniformly dispersed in the blend upon handling. The resulting non-dusting product was found to have excellent bunker-flow properties, and, even after being allowed to stand for three days, unrestrained flow was obtained with a bunker opening of only 0.4 mm.

What is claimed is:

1. In a process for preparing a relatively dry coal product from aqueous slurries of, respectively, relatively fine and relatively granular coal particles by agitating the relatively fine particles in contact with water and a binder to form agglomerates which are mechanically separable from the liquid in which they were formed, mechanically separating the agglomerates from the liquid and mixing them with the relatively granular coal particles, the improvement comprising:

before said agglomerates are mechanically separated from liquid in which they were formed, mixing the liquid containing them with a slurry of the relatively granular particles in proportions such that the agglomerates constitute from about 20 to 65% by weight of the solids within that mixture; and subsequently dewatering the mixture under conditions causing the disintegration of at least a significant proportion of said agglomerates.

* * * * *